US006159138A

United States Patent [19]

Lanvin et al.

[11] Patent Number: 6,159,138

[45] Date of Patent: Dec. 12, 2000

[54] FOLDER HAVING A CYLINDER WITH RETRACTABLE GRIPPERS AND A COOPERATING CYLINDER WITH RETRACTABLE COPY GUIDING DEVICES

[75] Inventors: Serge Lanvin, Cires les Mello; Eddie Smelten, Laigneville; Thierry Vauchelle, Saint Just en Chaussee, all of France

[73] Assignee: Heidelberger Druckmaschinen AG, Heidelberg, Germany

[21] Appl. No.: 09/238,856

[22] Filed: Jan. 27, 1999

[30] Foreign Application Priority Data

Jan. 27, 1998 [FR] France ..... 98 00843

[51] Int. Cl.[7] ..... B31F 7/00

[52] U.S. Cl. ..... 493/359; 493/360; 493/361; 493/424

[58] Field of Search ..... 493/359, 360, 493/361, 418, 429, 460, 424, 476, 432; 83/310, 346, 347, 343, 331, 663

[56] References Cited

U.S. PATENT DOCUMENTS

| | | | |
|---|---|---|---|
| 3,784,187 | 1/1974 | Takayanagi et al. | 493/359 |
| 4,218,053 | 8/1980 | Heimlicher | 493/359 |
| 4,559,032 | 12/1985 | Fischer | 493/359 |
| 5,004,451 | 4/1991 | Prum | 493/359 |
| 5,443,437 | 8/1995 | Mack | 493/359 |
| 5,484,379 | 1/1996 | Stab | 493/359 |
| 5,676,056 | 10/1997 | Stein et al. | 493/359 |

FOREIGN PATENT DOCUMENTS

| | | |
|---|---|---|
| 43 42 037 C1 | 3/1995 | Germany . |
| 0 656 307 A1 | 6/1995 | Germany . |
| 44 46 753 A1 | 12/1995 | Germany . |

*Primary Examiner*—Stephen F. Gerrity
*Assistant Examiner*—Sam Tawfik
*Attorney, Agent, or Firm*—Herbert L. Lerner; Laurence A. Greenberg; Werner H. Stemer

[57] ABSTRACT

A folder for a rotary printing press, having at least one copy-guiding cylinder and, on the one copy-guiding cylinder, gripping devices for gripping one end of a copy, includes a cutting cylinder cooperating with the one copy-guiding cylinder, and copy-guiding devices provided on the cutting cylinder, the gripping devices of the one copy-guiding cylinder and the copy-guiding devices of the cutting cylinder being retractably and extensibly movable substantially parallel to normals to axes of rotation of the one copy-guiding cylinder and the cutting cylinder; and a method of operating the folder.

13 Claims, 8 Drawing Sheets

FOLDER HAVING A CYLINDER WITH RETRACTABLE GRIPPERS AND A COOPERATING CYLINDER WITH RETRACTABLE COPY GUIDING DEVICES

BACKGROUND OF THE INVENTION

Field of the Invention

The invention relates to a folder for rotary printing presses, in particular, a pinless folder, and a method of operating the folder.

A folder for a printing press has been disclosed in the prior art, as exemplified by the published German Patent Document DE 44 46 753 A1. The folder is made up of a first folding cylinder provided with controllable grippers, and a second folding cylinder likewise provided with controllable grippers. The second folding cylinder is provided with additional controllable grippers, besides the controllable grippers already present on the circumference thereof, in order to press the trailing end of signatures against the circumference of the folding cylinder. The additional controllable grippers, respectively, are formed of a spring-steel blade which is held by a bearing connected to a transversely disposed tube. The additional controllable grippers, respectively, cooperate with a holder carrying a bar formed of elastic material.

The published German Patent Document DE 43 42 037 C1 discloses a method and a device for cross-folding signatures. In a folder which is arranged downline of a rotary printing press and has a collecting cylinder, the signatures are cross-folded in half in the initial region of a first and leading half, respectively, of signatures, the respective first and leading half being retained by holding devices. This occurs by having a folding blade penetrate into folding jaws of a jaw cylinder, copies which have been folded in half being retained in the folding jaws. Then, in a region of the point of intersection of an imaginary plane connecting the axes of rotation of the cylinders and a tangent to the circumference of the collecting cylinder, a respectively second and trailing half of the signatures is gripped, and secured, in an end region thereof by a controllable securing device. Thereafter, respectively, the initial region of the first and leading half of the signatures is released by the retaining devices of the collecting cylinder at the latest when the latter is at zero speed, or near zero speed, until the beginning and the end of the signatures retained in the folding jaws, respectively, are located more or less above one another. Finally, the securing device of the jaw cylinder again releases the trailing and second half, respectively, of each copy.

The problem of a so-called whiplash effect arises in cross-folding operations. The high accelerations which occur during transfers of copies from one cylinder to the other result in uncontrolled spreading and fanning out, respectively, of the end of the second, i.e., trailing, half of a signature; a folding-over or dog-earing of corners is also possible. In the solution to this problem set forth in the aforementioned published German Patent Document DE 43 42 037 C1, only part of the problem is solved, because the other end of the signature remains free. In previous attempts to find a solution, the problem has also occurred that an outwardly extending movement of the copy-gripping grippers into the nip between copy-guiding cylinders has always resulted, during a relatively longer period of rotation of the cylinders in the circumferential direction, in an increase in size of the enveloping curve around the relevant cylinder.

SUMMARY OF THE INVENTION

It is accordingly an object of the invention to provide a folder for rotary printing presses wherein the product transfer of a signature from one copy-guiding cylinder to the other is optimized, and a method wherein occurring accelerations are controllable.

With the foregoing and other objects in view, there is provided, in accordance with one aspect of the invention, a folder for a rotary printing press, having at least one copy-guiding cylinder and, on the one copy-guiding cylinder, gripping devices for gripping one end of a copy, comprising a cutting cylinder cooperating with the one copy-guiding cylinder, and copy-guiding devices provided on the cutting cylinder, the gripping devices of the one copy-guiding cylinder and the copy-guiding devices of the cutting cylinder being retractably and extensibly movable substantially parallel to normals to axes of rotation of the one copy-guiding cylinder and the cutting cylinder.

In accordance with another feature of the invention, the folder includes displaceable supports whereon holding devices and copy-guiding devices are arranged.

In accordance with a further feature of the invention, the folder includes sliding guides whereon the supports are displaceable.

In accordance with an added feature of the invention, the copy-guiding devices are guidable, in the manner of a coulisse or connecting link, substantially parallel to a normal to the axis of rotation of the cutting cylinder.

In accordance with an additional feature of the invention, the folder includes a rotatable adjusting shaft, and the support for the copy-guiding devices is actuatable via a lever connection by rotation of the adjusting shaft.

In accordance with yet another feature of the invention, the folder includes a control roller for actuating the adjusting shaft.

In accordance with yet a further feature of the invention, the folder includes an energy storage device by which the adjusting shaft is actuatable.

In accordance with yet an added feature of the invention, the copy-guiding devices are mutually spaced apart beside one another on the respective supports.

In accordance with yet an additional feature of the invention, the folder includes a cutting-blade mount provided on the cutting cylinder, and the copy-guiding devices, in a retracted condition thereof, penetrate into recesses formed in the cutting-blade mount.

In accordance with still another feature of the invention, the supports are formed with openings having fastening elements extending therethrough.

In accordance with still a further feature of the invention, the folder includes a control roller cooperating with a control cam, the supports being connected by connecting webs to the control roller.

In accordance with still an added feature of the invention, the control cam is an open control cam.

In accordance with an alternative feature of the invention, the control cam is a closed control cam.

In accordance with still an additional feature of the invention, the folder includes a spring element for maintaining continuous pretensioning between the open control cam and the control roller, the spring element being disposed between the respective supports and a guide body.

In accordance with another aspect of the invention, there is provided a method for transferring an end of a material web, after a cutting operation, to a first moving surface, which comprises: severing a copy from a material web in a cutting nip between the first moving surface and a second moving surface; extending a copy-guiding device and bringing it into contact with a leading end of the material web on the first moving surface, upon passage thereof through a cutting-nip outlet; gripping the leading end of the material web by holding devices moving out of the first moving surface during the passage thereof through the cutting-nip outlet; and retracting the copy-guiding devices into the second moving surface.

In accordance with another mode, the method according to the invention includes extending the holding devices on the first moving surface in a movement having a direction counter to a transporting direction of the material web through the cutting-nip outlet.

In accordance with a further mode, the method according to the invention includes causing outer sides of the copy-guiding devices to act upon the leading end of the material web and bring it into contact with the first moving surface.

In accordance with an added mode, the method includes superimposing a rotary movement on the retracting/extending movement of the holding devices.

In accordance with a concomitant mode of the method, during the retracting/extending movement of the holding devices, a control roller runs on a control cam, and a guide body forming a sliding surface for a support is pivoted by a rotation of an adjusting shaft.

Many different advantages are achievable with the foregoing features and modes of the invention. The holding or retaining devices allow the open material-web ends to be fixed at a particularly critical point in time during the transfer between the moving surfaces of the cylinders.

The holding or retaining and copy-guiding devices according to the invention allow considerably more precise guidance of the respectively leading material-web end in the cutting-nip outlet and thus permit higher production speeds for folders.

In a further configuration of the concepts according to the invention, the holding and copy-guiding devices are arranged on displaceable supports, which allow more precise guidance thereof. The supports can be constructed, in a straightforward manner from a production point of view, as sliding guides. If the copy-guiding devices are guided, in the manner of a coulisse or connecting link, substantially parallel to normals to the axes of rotation of the cylinders, it is possible to define precise retracting and extending movements which can also be adapted or matched to the different material-web thicknesses which are to be processed in each case. The supports of the copy-guiding devices can be displaced via a lever connection by the rotation of an adjusting shaft, whereon the lever connection is arranged.

The adjusting shaft, in turn, may be constructed so that it can be actuated via a control roller or by an energy storage device.

The copy-guiding devices may be arranged beside one another like the tines of a rake, so that they do not collide with the holding or retaining devices moving out of the opposite cylinder in the cutting-nip outlet. Furthermore, in the retracted state, the copy-guiding devices penetrate into recesses formed in the cutting-blade mount and thus do not impair the geometry of the cutting nip.

The supports whereon the holding or retaining devices are accommodated are provided with openings which have fastening elements extending therethrough. The position of the displacement path of the supports is precisely defined in this manner, the top and bottom dead center positions being fixed. The supports are moved by a control roller rolling on a control cam, the roller being connected to the supports via connecting webs. The control cam may be a closed control cam or an open control cam. When an open control cam is used, a spring element is additionally provided in order to ensure the contact between the surfaces of the control cam and the control roller by maintaining a pretensioning therebetween.

The invention of the instant application also calls for a method for transferring an end of a material web, after a cutting operation, to a first moving surface, as described hereinbefore. The method includes the following method steps: severing a copy from a material web in a cutting nip between a first moving surface and a second moving surface; extending copy-guiding devices and bringing them into contact with a leading end of the material web on a first moving surface, upon passage thereof through a cutting-nip outlet; gripping the leading end of the material web by holding or retaining devices, which move out of the first moving surface during passage through the cutting-nip outlet; and retracting the copy-guiding devices into the second moving surface.

A further mode of the method is that the extending movement of the holding or retaining devices on the first moving surface is in a direction counter to the transporting direction of the material web through the cutting-nip outlet. Furthermore, the outer sides of the copy-guiding device are in contact with the leading end of the material web and place it against the first moving surface. Finally, the movement of the holding or retaining device, respectively out of and into the first moving surface has a rotary movement superimposed thereon. During the retracting and extending movement of the holding or retaining devices by the control roller running on the control cam, the guide body, which forms the sliding surface for the support, is pivoted due to the rotation of the adjusting shaft. The adjusting shaft may be rotated either via a cam-roller mechanism or via electromotive adjustment or the like.

Other features which are considered as characteristic for the invention are set forth in the appended claims.

Although the invention is illustrated and described herein as embodied in a folder for rotary printing machines and method of operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
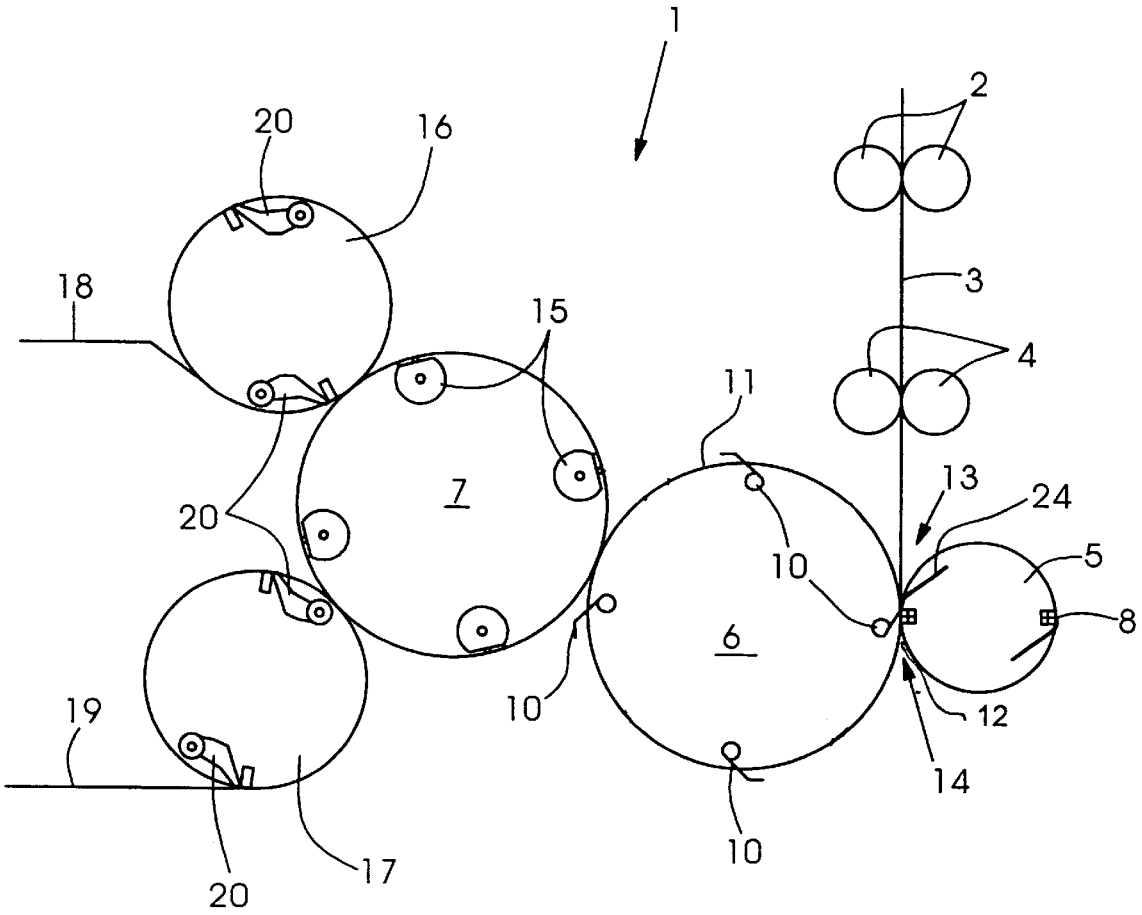
FIG. 1 is a diagrammatic side elevational view of a cylinder configuration according to the invention with a cutting cylinder assigned to a copy-guiding cylinder.

Referring now to the drawings and, first, particularly to FIG. 1 thereof, there is shown therein, in a side elevational view, a cylinder configuration according to the invention in a folder with a cutting cylinder 5 assigned to a copy-guiding cylinder 6.

A material web 3, which runs into the folder 1 via first and second draw-roller pairs 2 and 4, respectively, is transported, without any interposition or intermediate connection of transport or conveyor belts, into a cutting nip 12 between a first copy-guiding cylinder 6 and the cutting cylinder 5. The cutting cylinder 5 has two cutting blades 8 and can accommodate two copies behind one another on the casing surface thereof, in this context, the cutting cylinder 5 being of double diameter, i.e., twice the diameter of the conventional plate, blanket or impression cylinder of a printing unit, whereas the first copy-guiding cylinder 6, namely a folding-blade cylinder, can accommodate four copies behind one another on the circumferential surface 11 thereof, in this configuration. Copy-retaining or holding devices of the folding-blade cylinder 6 are described hereinafter in more detail with reference to other described figures. The folding-blade cylinder 6 interacts with a folding-jaw cylinder 7 likewise accommodating four copies in this configuration and provided with folding jaws 15. Grippers 20 on two transporting cylinders 16 and 17 remove the cross-folded copies from the circumference of the jaw cylinder 7 and direct them to an upper and a lower delivery 18 and 19, respectively.

Figure 2:
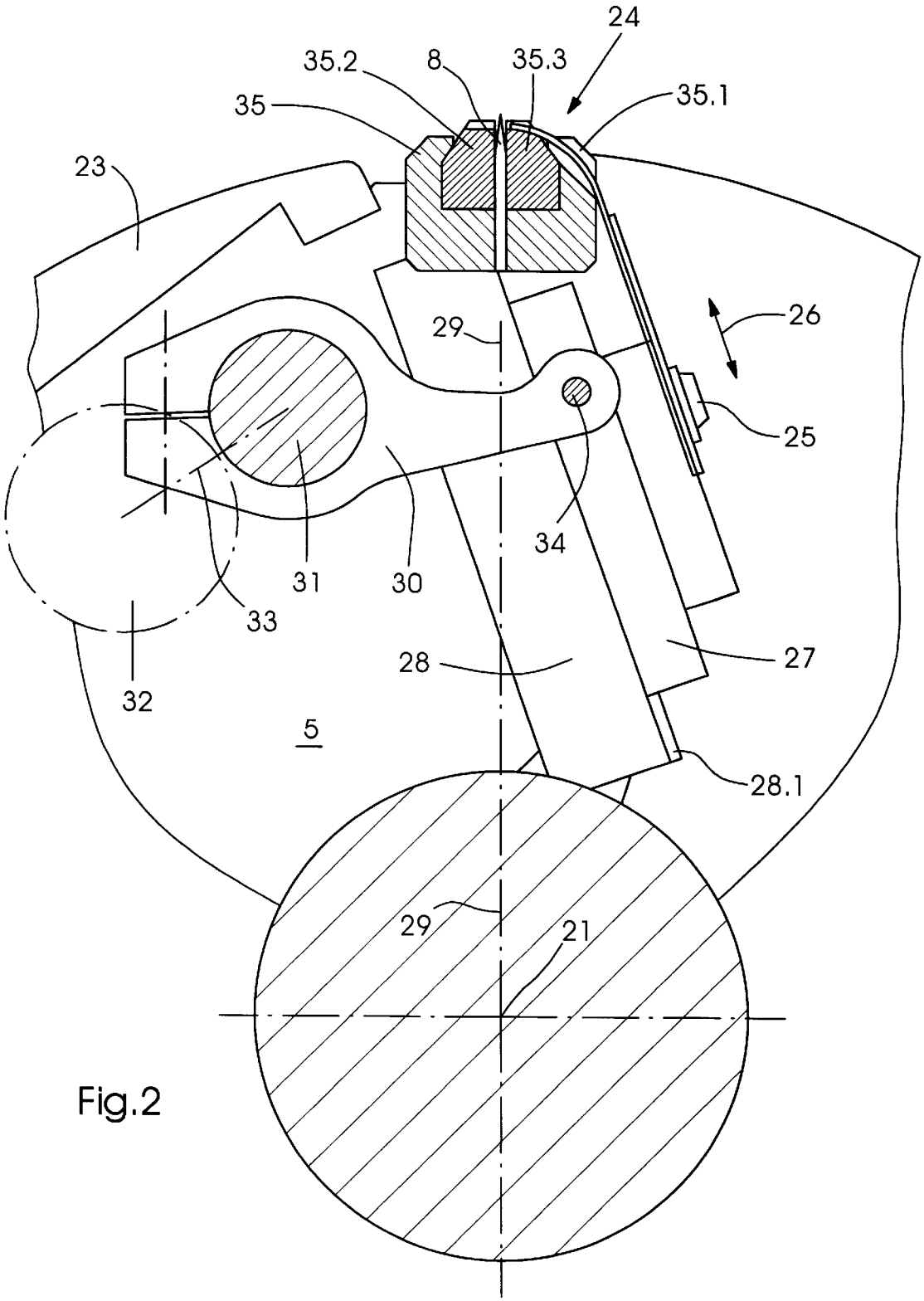
FIG. 2 is a much-enlarged fragmentary view of FIG. 1, showing the cutting cylinder with a copy-guiding device in a retracted condition arranged thereon so as to be movable on a coulisse or connecting-link guide.

FIG. 2 illustrates a cutting cylinder 5 with a copy-guiding device 24 movable by a coulisse or connecting link 28.1 and being in an operating stage or phase wherein it is retracted into the cutting cylinder 5.

The cutting cylinder 5 shown fragmentarily in FIG. 2 rotates about an axis 21 thereof and is provided on a casing surface 23 thereof with at least one cutting blade 8 which cooperates with grooved bars 39 (note FIG. 5) provided on the first copy-guiding cylinder 6, i.e., the folding-blade cylinder, located opposite thereto in this case, in order to sever copies from the material web 3. The cutting blade 8 is accommodated in a cutting-blade mount 35 which is formed with recesses 35.1 on one side thereof. The cutting-blade mount 35 is furthermore formed of two clamping strips 35.2 and 35.3 made of yieldable elastic material and holding the cutting blade 8 therebetween.

Provided beneath the cutting-blade mount 35 is a guide 28 which, only slightly inclined, extends substantially parallel to a normal 29 to the axis of rotation 21 of the cutting cylinder 5. The guide 28 may include a sliding guide 28.1, similar to a coulisse or connecting-link guide, whereon a support 27 is displaceable in a substantially vertical direction. The copy-guiding device 24 is fixed on the support 27 by a fastener 25. In the retracted condition, an upper bent end of the copy-guiding device 24, as viewed in the direction of the cutting blade 8, engages in the recess 35.1 formed in the cutting-blade mount 35. The retraction and extension movement of the copy-guiding device 24, which takes place substantially parallel to the normal 29, is produced by a vertically directed sliding movement of the support 27 on the sliding guide 28.1, for example, a coulisse or connecting-link guide. Clamped on a shaft 31 is a lever 30 of which an elongated lever arm is connected to the support 27 by a bolt 34. Via a control roller 32, which rolls on a control cam 36 (note FIG. 4), a further lever 33, represented in phantom by a dot-dash line, causes the adjusting shaft 31 to rotate, the rotation thereof being transmitted to the support 27 by the elongated arm of the lever 30, as a vertical sliding movement. The substantially vertically directed retraction and extension movement of the copy-guiding device 24 is indicated by the double arrow 26 located alongside the copy-guiding device 24.

Figure 3:
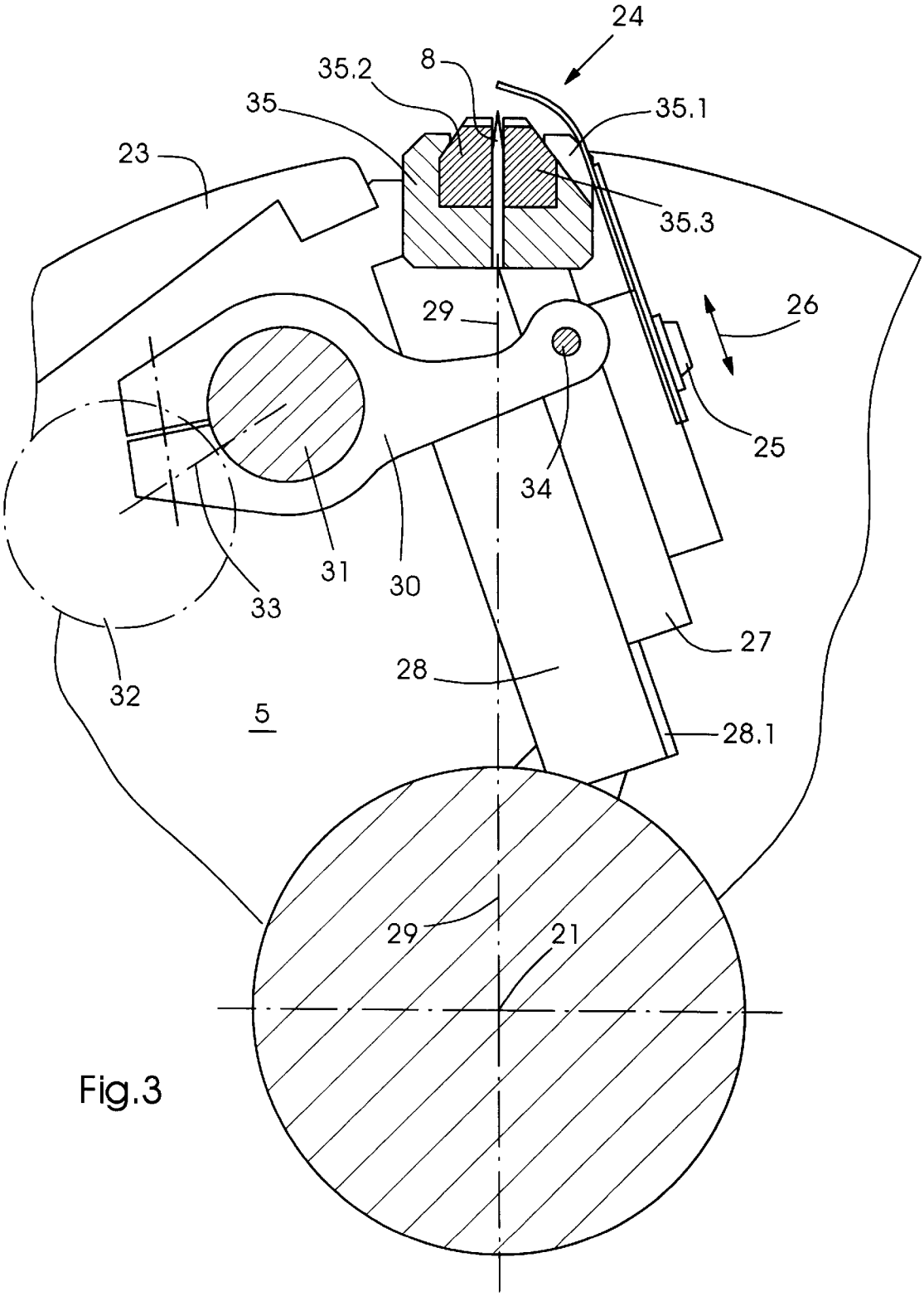
FIG. 3 is a view like that of FIG. 2 showing the movable copy-guiding device in a different operating phase thereof, namely in an extended condition thereof.

The copy-guiding device 24 described hereinbefore with regard to FIG. 2 is illustrated in FIG. 3 in an operating phase or stage wherein it is extended out of the cutting cylinder 5.

The support 27 whereon the copy-guiding device 24 is accommodated is extended out of the cylinder 5 by the aforedescribed movement of the levers 30 and 33 about the adjusting shaft 31. In this operating phase or stage, the individual tongues of the copy-guiding device 24, of which a multiplicity may be arranged beside one another over the width of the cutting cylinder 5, cover the cutting blade 8. The rotation of the adjusting shaft 31 in a counterclockwise direction results in the displacement of the support 27 along the sliding guide 28.1 thereof into a top dead center position. In this stage, the bent ends of the copy-guiding devices 24 extend out of the interior of the cutting cylinder 5 in the manner illustrated.

If the illustration according to FIG. 3 is transferred into FIG. 1 as described hereinbefore, with the first copy-guiding cylinder 6 disposed opposite the cutting cylinder 5, the following takes place:

The copies are severed from the material web 3 by the cooperation or interaction of the cutting blades 8 with the grooved bars 39 of the first copy-guiding cylinder 6. In the cutting-nip outlet 14 following the cutting nip 12, the extensioning movement of the copy-guiding devices 24 out of the casing surface 23 of the cutting cylinder 5, that extensioning movement being represented in FIG. 3 by the arrow 26, results in one end of a respectively new copy being pressed onto the circumferential surface 11 of the first copy-guiding cylinder 6. The respectively newly formed copy ends are pressed, immediately after the cutting performed in the cutting nip 12 by the cutting blade 8 and the grooved bar 39, onto the circumferential surface 11 of the first copy-guiding cylinder 6, whereat, as is described hereinbelow, they are received by retaining devices 10. In the case of multi-layered material webs 3, satisfactory transfer of the copies onto the circumferential surface 11 of the first copy-guiding cylinder 6, in this case the cutting-blade cylinder, is assured.

Figure 4:
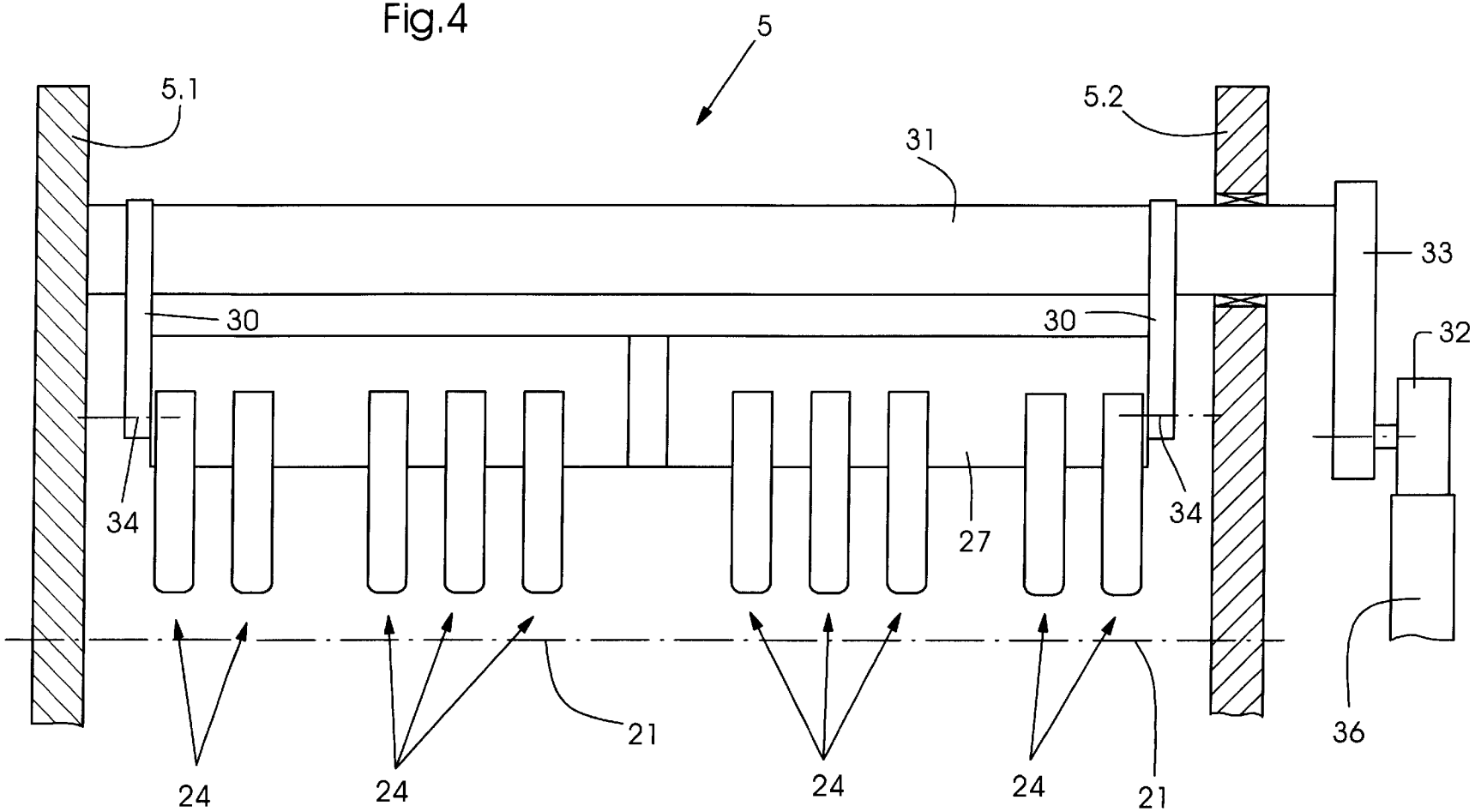
FIG. 4 is a top plan view of a plurality of the copy-guiding devices on the cutting cylinder.

FIG. 4 is a plan view of the copy-guiding devices on the cutting cylinder 5.

This diagrammatically illustrated plan view of the cutting cylinder 5 shows, on the right-hand side thereof, the control roller 32, which rolls on a control cam 36, and by which movement of the adjusting shaft 31 is initiated. Fastened at the end regions of the adjusting shaft 31, in turn, are the levers 30 with the elongated lever arms thereof which, via bolts 34, cause the retraction and the extension movement, represented by the double-headed arrow 26, of the support 27, as is illustrated in FIGS. 2 and 3. A multiplicity of copy-guiding devices 24 are arranged on the support 27, as viewed over or along the width of the cutting cylinder 5, and the bent ends of these copy-guiding devices (note FIG. 3) penetrate into the aforementioned recesses 35.1 of the cutting-blade mount 35 on the cutting cylinder 5. The adjusting shaft 31 is mounted rotatably in bearings in the end surfaces 5.1 and 5.2 of the cutting cylinder 5 which, in turn, rotates about the rotational axis 21 thereof.

Figure 5:
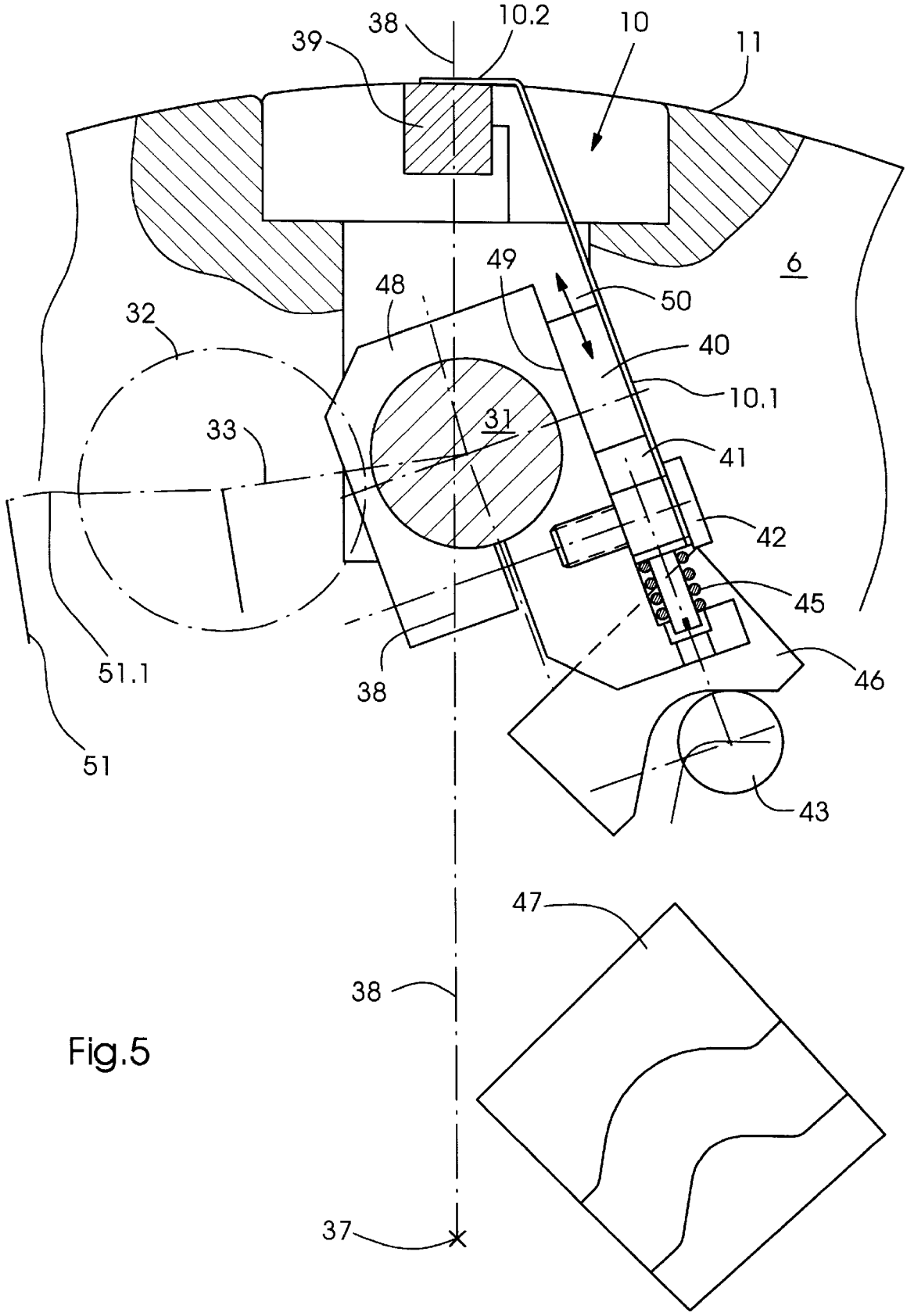
FIGS. 5, 6 and 7 are views like those of FIGS. 2 and 3 of other embodiments of the copy-guiding devices in various operating positions thereof, showing additional retaining devices accommodated on the copy-guiding cylinder and likewise guided in the manner of a coulisse or connecting link.

FIG. 5 shows, in a retracted position, an additional holder or retainer 10 accommodated on the first copy-guiding cylinder 6.

Grooved bars 39 are accommodated on the first copy-guiding cylinder 6, which rotates about the rotational axis 37 thereof. The grooved bars 39 are sunk into or embedded in the circumferential surface 11 of the first copy-guiding cylinder 6 and, together with the cutting blades 8 which are accommodated on the cutting cylinder 5, cause copies to be severed from the material web 3 in the cutting nip 12.

Figure 8:
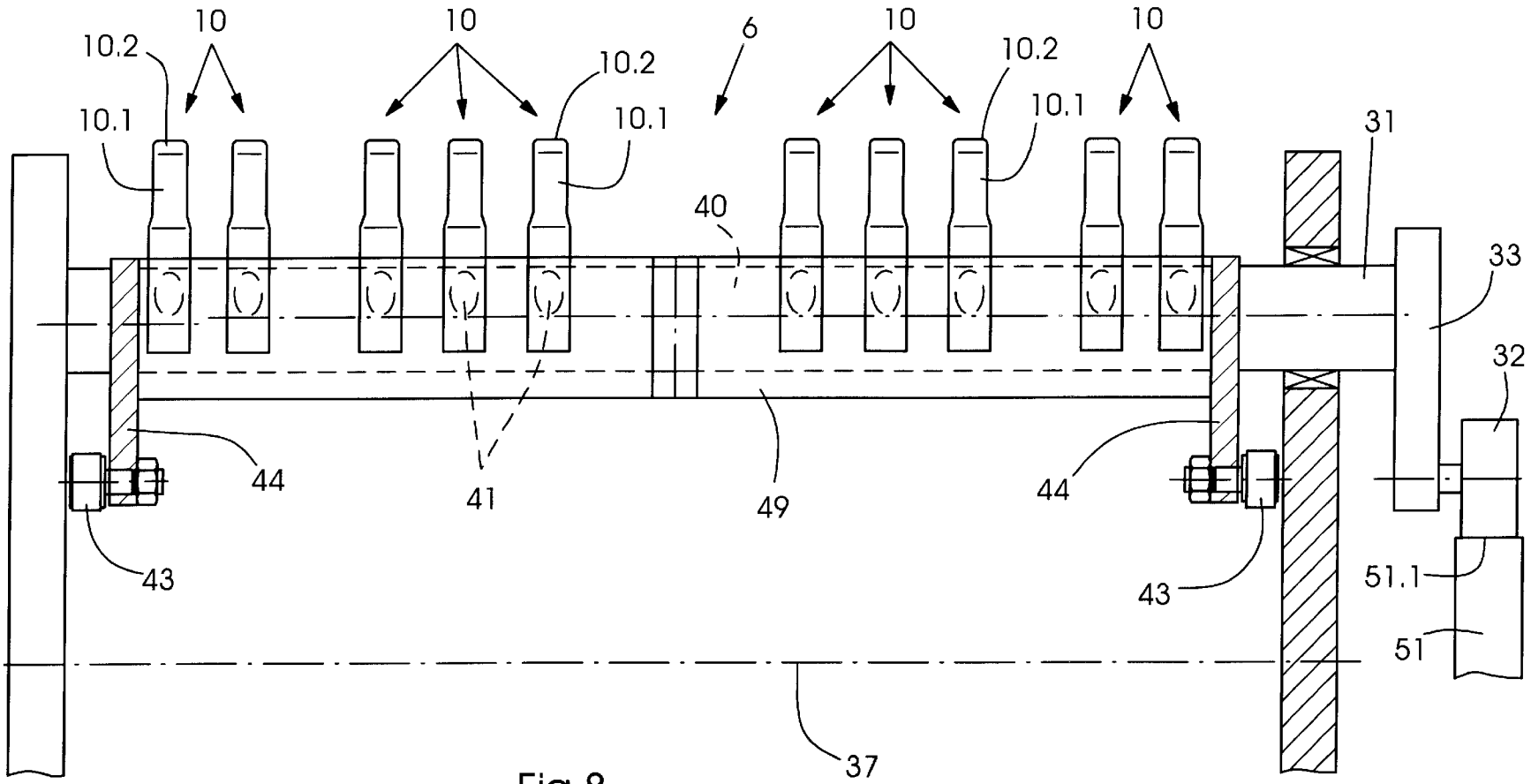
FIG. 8 is a plan view of the coulisse or connecting-link type of guidance of the additional retaining devices on the copy-guiding cylinder.

The holders or retainers 10 are formed of a bent end 10.2 that engages over the respective copy end above the grooved bar 39, and a guiding part 10.1, by which the holders 10 are accommodated beside one another on a support 40. The support 40 which accommodates the holders 10 executes a movement represented by the double-headed arrow 50, respectively, out of and into the interior of the first copy-guiding cylinder 6. This extensioning and retracting movement of the holder or retainer 10 on the first copy-guiding cylinder 6 takes place substantially parallel to the normal 30 to the axis of rotation 37 of the first copy-guiding cylinder 6. The support 40 moves along a guide surface 49 of the guide body 48, which may be formed as a sliding guide, or a coulisse or connecting-link guide. The support 40 is provided with a plurality of openings 41, which may be formed as slots or the like. The length of the openings 41 in the support 40 define the top and bottom dead center positions of the displacement path of the support 50 along the guide surface 49. A fastener 42 connects the support 40 to the holders or retainers 10 accommodated thereon, and the guide bodies 48 to one another, so as to ensure vertical upward and downward movement of the support 40 along the guide surface 49. The rotary and lowering movements required during the retracting movement of the holders or retainers 10 into the first copy-guiding cylinder 6 are produced as follows:

Via the guide body 48, the holders or retainers 10 can be rotated on an adjusting shaft 31, that may be of the same construction as that of the adjusting shaft 31 in FIGS. 2 and 3. This rotation is performed by a control roller 32 running on a contour 51.1 of a control cam 51. The control roller 32 is connected via a lever 33 to the adjusting shaft 31, analogously to the construction in the copy-guiding devices 24, and, depending upon the course of the control-cam contour, causes the adjusting shaft 31 to rotate. Because the guide body 48 is clamped onto the adjusting shaft 31, it follows the rotary movements of the latter in or counter to the clockwise direction. In addition to the rotary movement of the holding or retaining devices 10, the retraction of the latter into the interior of the first copy-guiding cylinder 6 also requires a lowering movement of the holding or retaining devices 10. For this purpose, the support 40, on the upper side of which the holding or retaining devices 10 are located, is connected to a control roller 43 via a lever 44 which, in the interest of clarity, is not illustrated in FIG. 5, but is shown in FIG. 8, the control roller 43, for its part, cooperating or interacting with a control cam 46 that is shown only diagrammatically in FIG. 5.

Accordingly, FIG. 5 illustrates an open control cam 46 that cooperates or interacts with the control roller 43. In order to ensure permanent contact between the contour of the control cam 46 and the control roller 43, a spring element 45 is provided for ensuring the maintenance of a constant prestressing or pretensioning between the control roller 43 and the contour of the control cam 46. Alternatively, a closed cam may be employed so that it is possible to dispense with the installation of a spring element 45 because, in such an embodiment, the control roller 43 is guided positively on both sides, as a result of which it is not possible for the bearing surfaces to lose contact therebetween.

Figure 6:
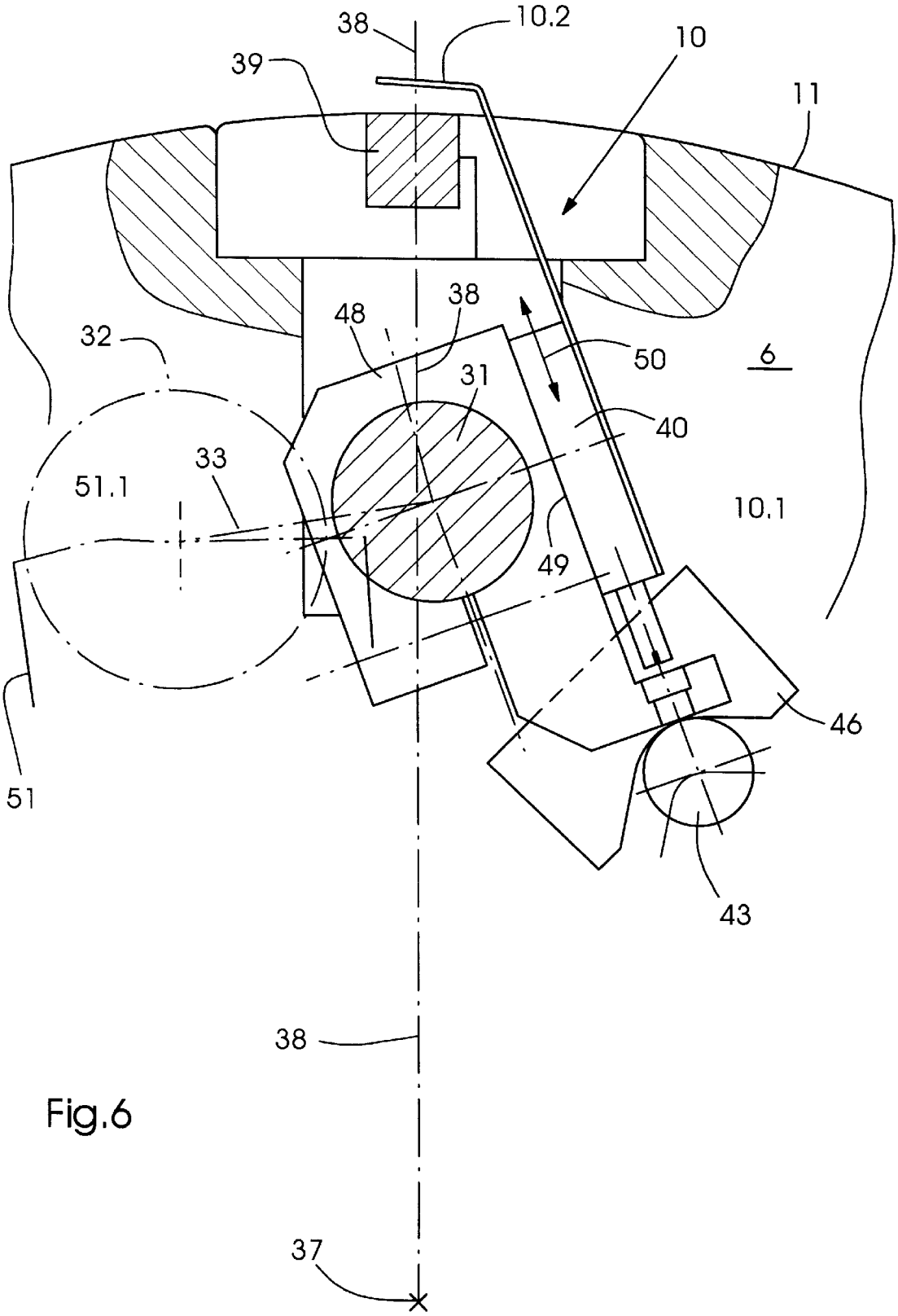

FIG. 6 shows how the holding or retaining devices on the first product-guiding cylinder 6 have moved into an extended position.

A comparison of the positions of the control roller 32 relative to the control-cam contour 51.1 and of the control roller 43 relative to the control cam 46 shows that both the rotation of the holding or retaining devices 10 and an extensioning movement of the retaining devices 10 out of the first copy-guiding cylinder 6 have taken place. In comparison with the operating-phase position illustrated in FIG. 5, the control roller 32 in FIG. 6 has moved a given distance along the contour 51.1 of the control cam 51, which has resulted in a rotation of the adjusting shaft 31 in a clockwise direction, which is apparent from the gap appearing between the guiding part 10.1 and the grooved bar 39. At the same time, the control roller 43 has moved relative to the control cam 46, which has resulted in a displacement of the support 40 along the sliding surface 49, which is apparent from the top dead center position of the support 40 relative to the guide body 48 and the guide surface 49 thereof. The slot-like openings 41 are not illustrated in FIG. 6. The maximum extensioning movement of the holding or retaining devices 10 over the circumferential surface 11 of the first copy-guiding cylinder 6 coincides with the attainment by the control roller 43 of the lowest point of the control cam 46, relative to the contour of the control cam 46. This applies as well for the use of the closed cam 47.

Figure 7:
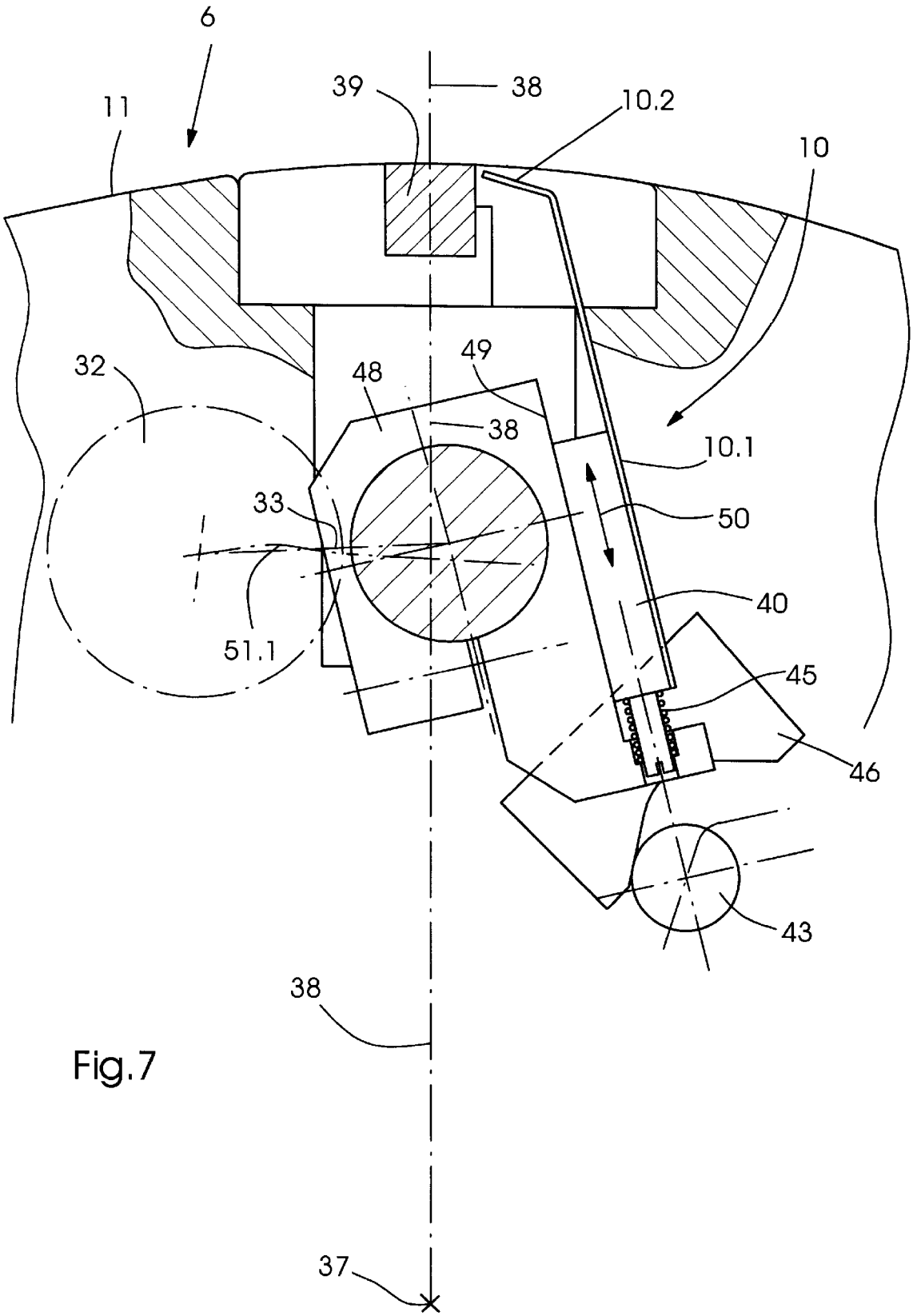

FIG. 7, finally, shows the holding or retaining devices 10 after they have been moved back again to a full extent behind the circumferential surface 11 of the first copy-guiding cylinder 6.

A comparison of FIG. 7 with the preceding FIG. 6 shows that the positions of the control roller 32 relative to the control cam 51 and of the control roller 43 relative to the control cam 46 has changed again. The control roller 32, which runs on the control-cam contour 51.1, causes a further rotation of the adjusting shaft 31, as a result of which the bent end 10.2 of the holding or retaining device 10 is rotated alongside the grooved bar 39, so that the holding or retaining devices 10 can penetrate into the cylinder interior immediately thereafter.

After the holding or retaining devices 10 have rotated into the clearance alongside the grooved bar 39, the support 40, that is connected to the control roller 43 via the lever 44 (FIG. 8), is drawn into the first copy-guiding cylinder 6, the control roller 43 following the contour of the control cam 46. In this operating-phase position, the control roller 43, which runs on the control cam 46, has reached a high position, relative to the contour of the control cam 46. In this operating-phase position, the spring element 45 is compressed between the support 40 and the guide body 48. In the phase condition shown in FIG. 7, the holding or retaining devices 10 are located in the bottom dead center position of the substantially vertically-running retracting movement into the cylinder interior.

FIG. 8 is a plan view of a coulisse or connecting-link type guide of the additional holding or retaining elements on the first copy-guiding cylinder 6.

The plan view of the first copy-guiding cylinder 6 illustrated only diagrammatically therein, and having only stylized end sides, which are not represented in greater detail, shows that the adjusting shaft 31 is mounted in these end sides. The rotation of the adjusting shaft 31 is introduced into the end sides by way of the control roller 32, which is accommodated on the lever 33. The control roller 32 runs on the contour 51.1 of the control cam 51 and ensures the aforedescribed rotary movement of the holding or retaining devices 10. FIG. 8 also shows the displacement path, predetermined by the openings 41, which the holding or retaining devices 10 cover on the support 40, as being moved out of or into the cylinder interior. In this case, the support 40 moves on the sliding surface 49 of the guide body 48, which is not illustrated any more specifically in FIG. 8, and is clamped on the circumference of the adjusting shaft 31. It is also apparent from FIG. 8 that the control rollers 43 are connected to the support 40 via levers 44 and introduce the sliding movement into the support 40 after the rotary movement of the retaining devices 10 has taken place. The open cam 46 and the closed cam 47, respectively, are not illustrated in FIG. 8.

Returning to the illustration according to FIG. 1, an operating sequence of the holding or retaining devices 10 according to the invention and copy-guiding devices 24 according to the invention can be gathered from what has been described above, and this operating sequence proceeds as follows:

After a copy has been severed from the leading end of a material web 3 in the cutting nip 12, the copy-guiding devices 24 are extended out of the interior of the cutting cylinder 5. The copy-guiding devices 24 press the leading end of the material web 3 against the circumferential surface 11 of the first copy-guiding cylinder 6, that is located opposite the cutting cylinder 5. Consequently, in the case of multi-layered material webs, it is possible to prevent the leading end of the material web 3 in the cutting-nip outlet 14 from fluttering open or the corners thereof from becoming folded over or dog-eared. The respectively leading end of the copy which is to be newly severed from the material web 3 is pressed against the circumferential surface 11 of the first copy-guiding cylinder 6 by the copy-guiding devices 24. At the same time, the holding or retaining devices 10, which are provided on the first copy-guiding cylinder 6, in this case the folding-blade cylinder, are activated, so that, for the purpose of gripping the copy end, they extend substantially parallel to the normal 38 to the axis of rotation 37 of the cylinder 6, engage over the copy end, by virtue of the aforedescribed rotary movement, and then, due to the cooperation or interaction of the control roller 43 with the control cam 46, retract along the guide surface 49 into the interior of the first copy-guiding cylinder 6. This operating phase or stage is illustrated in FIG. 5. In this position, the bent ends 10.2 of the holding or retaining devices 10 engage over the end of the copy which is to be newly severed from the material web 3 and fix the end of the copy above the grooved bars 39 on the circumferential surface 11 of the first copy-guiding cylinder 6. In order to avoid a collision of respective active copy-guiding devices 24 with the holding or retaining devices 10 receiving the end of the copy, the devices 10 and 24, respectively, are staggered in relation to one another over the width of the respective cylinders 5 and 6, in order to allow them to overlap one another in a comb-like manner.

During the continuous, joint rotation of the first copy-guiding cylinder 6 with the cutting cylinder 5, the copy-guiding devices 24 of the latter retract into the cutting cylinder 5 again after the holding or retaining devices 24 have overlapped that end of a copy to be newly severed which is pressed onto the circumferential surface 11 of the first copy-guiding cylinder 6 by the copy-guiding devices 24.

We claim:

1. A folder for a rotary printing press, comprising:

a copy-guiding cylinder having an axis of rotation and including gripping devices for gripping one end of a copy, said gripping devices being retractable and extensible moveable substantially parallel to a normal to the axis of rotation of said copy-guiding cylinder;

a cutting cylinder cooperating with said copy-guiding cylinder and having an axis of rotation, said cutting cylinder including copy guiding devices that are retractable and extensible moveable substantially parallel to a normal to the axis of rotation of said cutting cylinder and a cutting blade mount provided on said cutting-cylinder, and wherein, in a retracted condition thereof, said copy-guiding devices penetrate into recesses formed in said cutting-blade mount.

2. The folder according to claim 1, including displaceable supports whereon holding devices and said copy-guiding devices are arranged.

3. The folder according to claim 2, including sliding guides whereon said supports are displaceable.

4. The folder according to claim 2, including a rotatable adjusting shaft, and wherein said support for the copy-guiding devices is actuatable via a lever connection by rotation of said adjusting shaft.

5. The folder according to claim 4, including a control roller for actuating said adjusting shaft.

6. The folder according to claim 4, including an energy storage device by which said adjusting shaft is actuatable.

7. The folder according to claim 2, wherein said copy-guiding devices are mutually spaced apart beside one another on said supports.

8. The folder according to claim 2, wherein said supports are formed with openings having fastening elements extending therethrough.

9. The folder according to claim 2, including a control roller cooperating with a control cam, said supports being connected by connecting webs to said control roller.

10. The folder according to claim 9, wherein said control cam is an open control cam.

11. The folder according to claim 10, including a spring element for maintaining continuous pretensioning between said open control cam and said control roller, said spring element being disposed between said support and a guide body.

12. The folder according to claim 9, wherein said control cam is a closed control cam.

13. The folder according to claim 1, wherein said copy-guiding devices are slidably guided.

* * * * *